US008695577B2

(12) United States Patent
LoRocco et al.

(10) Patent No.: US 8,695,577 B2
(45) Date of Patent: Apr. 15, 2014

(54) BOWSTRING RELEASE WITH ADJUSTABLE WRIST STRAP

(75) Inventors: Anthony T. LoRocco, Dallas, TX (US); John Estridge, Plano, TX (US); Damon Lamont Coalson, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 106 days.

(21) Appl. No.: 13/314,330

(22) Filed: Dec. 8, 2011

(65) Prior Publication Data

US 2013/0146042 A1 Jun. 13, 2013

(51) Int. Cl.
*F41B 5/18* (2006.01)

(52) U.S. Cl.
USPC ..... 124/35.2

(58) Field of Classification Search
USPC ..... 124/35.2
See application file for complete search history.

(56) References Cited

U.S. PATENT DOCUMENTS

| | | | | | |
|---|---|---|---|---|---|
| 2,453,010 | A | * | 11/1948 | Grafiln | 119/864 |
| 4,426,989 | A | * | 1/1984 | Sutton | 124/35.2 |
| 5,357,939 | A | | 10/1994 | Tentler et al. | |
| 5,595,167 | A | | 1/1997 | Scott | |
| 5,615,662 | A | | 4/1997 | Tentler et al. | |
| 5,785,010 | A | * | 7/1998 | Koch | 119/863 |
| 5,857,452 | A | | 1/1999 | Troncoso | |
| 5,934,599 | A | | 8/1999 | Hammerslag | |
| 5,937,841 | A | * | 8/1999 | Summers et al. | 124/35.2 |
| 6,125,833 | A | * | 10/2000 | Tentler et al. | 124/35.2 |
| 6,129,055 | A | * | 10/2000 | Hanada | 119/863 |
| 6,202,953 | B1 | | 3/2001 | Hammerslag | |
| 6,289,558 | B1 | | 9/2001 | Hammerslag | |
| 7,198,610 | B2 | | 4/2007 | Ingimundarson et al. | |
| 7,591,050 | B2 | | 9/2009 | Hammerslag | |
| 7,926,476 | B1 | * | 4/2011 | Tentler et al. | 124/35.2 |
| 7,950,112 | B2 | | 5/2011 | Hammerslag et al. | |
| 2007/0128959 | A1 | | 6/2007 | Cooke | |

* cited by examiner

*Primary Examiner* — John Ricci
(74) *Attorney, Agent, or Firm* — Alvin R. Wirthlin

(57) ABSTRACT

A bowstring release assembly is adapted for connection to the wrist of a user and includes a jaw mechanism adapted to receive, retain, and release a bowstring, and an adjustable wrist strap connected to the jaw mechanism via an extension member. The adjustable wrist strap includes a flexible base member adapted to fit around the wrist of a user. A first anchor member is connected to one end portion of the wrist strap and a second anchor member connected to another end portion. A cable is fixed with respect to one of the anchor members and is adapted to engage the other of the anchor members to thereby draw the first and second end portions toward each other and cinch the adjustable wrist strap around the wrist of a user.

22 Claims, 7 Drawing Sheets

BOWSTRING RELEASE WITH ADJUSTABLE WRIST STRAP

BACKGROUND OF THE INVENTION

This invention relates generally to archery equipment, and more particularly to a bowstring release assembly with an adjustable wrist strap.

Many accessories for archery bows are available for facilitating bow handling, stabilizing the bow during use, improving aiming accuracy, and so on. Once such accessory is in the form of a wrist strap with an attached bowstring release. Archery bowstrings of compound bows typically have pull forces on the order of about 40 to 90 pounds. The use of wrist straps has become common to accommodate these large forces which have the potential to cause possible injury to the archer's fingers. A wrist strap removes the force of the bowstring that would otherwise be present on the fingers and spreads the force over a relatively large surface area of the wrist and the back of the archer's hand while leaving at least the thumb or index finger of the hand free to activate the trigger mechanism of the bowstring release.

Since the hands and wrists of archers come in many different shapes and sizes, wrist straps are typically adjustable to accommodate as many archers as possible. Prior art solutions for adjustable wrist straps have included buckles and hook and loop fasteners. Buckles, while providing a relatively secure attachment to the wrist, are difficult to manipulate during installation on the wrist and adjustment about the wrist since only one hand is available to accomplish the task. In addition, since the wrist strap is typically installed on the right hand and wrist for a right-handed archer, for example, the left hand must be used for both installation and adjustment, contributing to additional awkwardness of the procedures. Moreover, since holes on the wrist strap are typically at discrete locations, the buckle solution is inadequate for many archers since the strap may be either too loose or too tight for comfort and/or for safety reasons. If the wrist strap is too loose, the force of the bowstring can cause the wrist strap to be pulled off of the archer's hand and cause potential damage to the archery bow and potential injury to the archer.

Although the provision of hook and loop fasteners in place of the buckle provides increased comfort, ease of attachment, and infinite adjustment of the wrist strap size over a substantial range, and can accommodate a generally wider spectrum of wrist sizes, there are significant drawbacks. For instance, the hooks of the fastener associated with one adjustable section of the wrist strap may not be in full locking engagement with the loops associated with another adjustable section of the wrist strap. This may be due to several reasons including partial straightening of the hooks from extended use, a failure to fully and properly engage the hooks and loops, the collection of interfering foreign material on the hooks and loops, and/or the placement of the hook and loop fasteners in an orientation whereby the force of the bowstring causes a peeling action to pull the hooks and loops apart. Further, for users having a rather large wrist, the engagement area of the hook and loop fastener may be reduced to the point where it is ineffective under the bowstring load.

If the wrist strap separates under load, the result can either be a misdirected shot, which in and of itself may have serious consequences, as well as possible injury to the archer since the bowstring will tend to pull the wrist strap from the wrist, causing the strap to flail about as the bowstring snaps forward. Since the archer's other hand and arm are positioned in close proximity to the path of bowstring movement, the wrist strap and/or the bowstring release may strike the archer's hand or arm under high velocity and with great force, potentially causing serious injury to the archer.

SUMMARY OF THE INVENTION

In accordance with one aspect of the invention, a bowstring release assembly is adapted for connection to the wrist of a user and includes a jaw mechanism adapted to receive, retain, and release a bowstring, and an adjustable wrist strap connected to the jaw mechanism. The adjustable wrist strap includes a flexible base member adapted to fit around the wrist of a user. The flexible base member has a first end portion, a second end portion, and a middle portion located between the first and second end portions. A first anchor member is connected to the first end portion and a second anchor member connected to the second end portion. A cable is fixed with respect to one of the anchor members and is adapted to engage the other of the anchor members to thereby draw the first and second end portions toward each other and cinch the adjustable wrist strap around the wrist of a user.

In accordance with a further aspect of the invention, an adjustable wrist strap includes a flexible base member adapted to fit around the wrist of a user. The flexible base member has a first end portion, a second end portion, and a middle portion located between the first and second end portions. A first anchor member is connected to the first end portion and a second anchor member connected to the second end portion. A cable is fixed with respect to one of the anchor members and is adapted to engage the other of the anchor members to thereby draw the first and second end portions toward each other and cinch the adjustable wrist strap around the wrist of a user.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
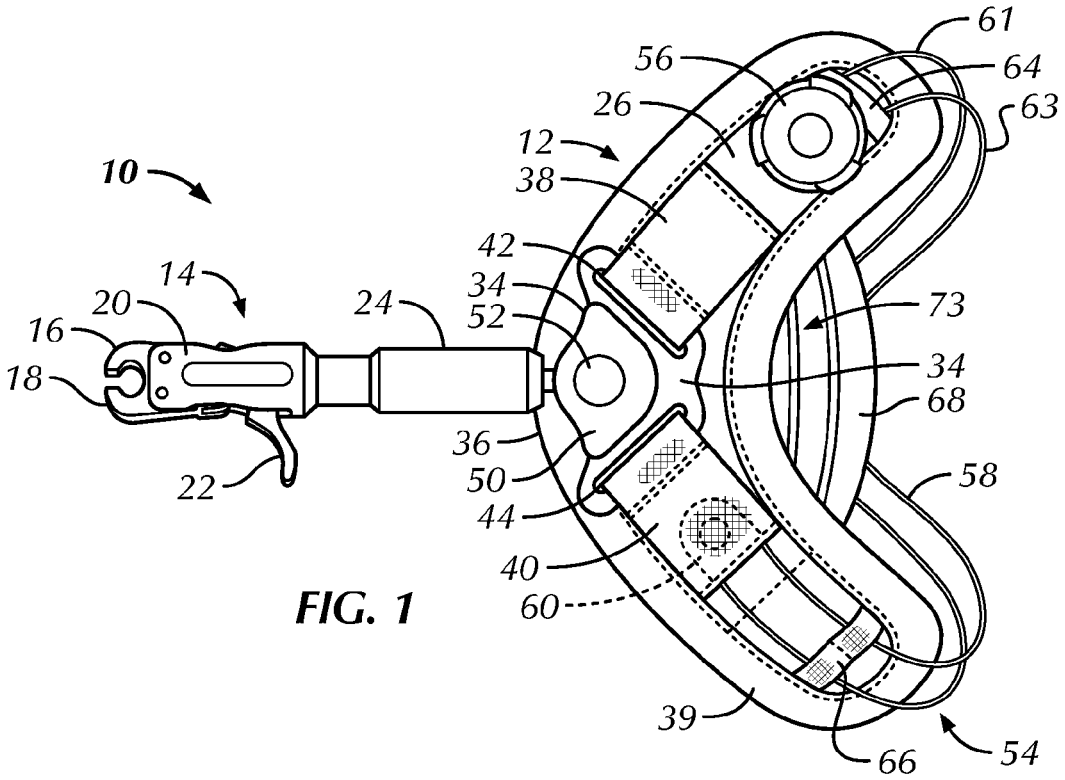
FIG. 1 is a top plan view of a bowstring release assembly with adjustable wrist strap in accordance with the present invention.
Figure 2:
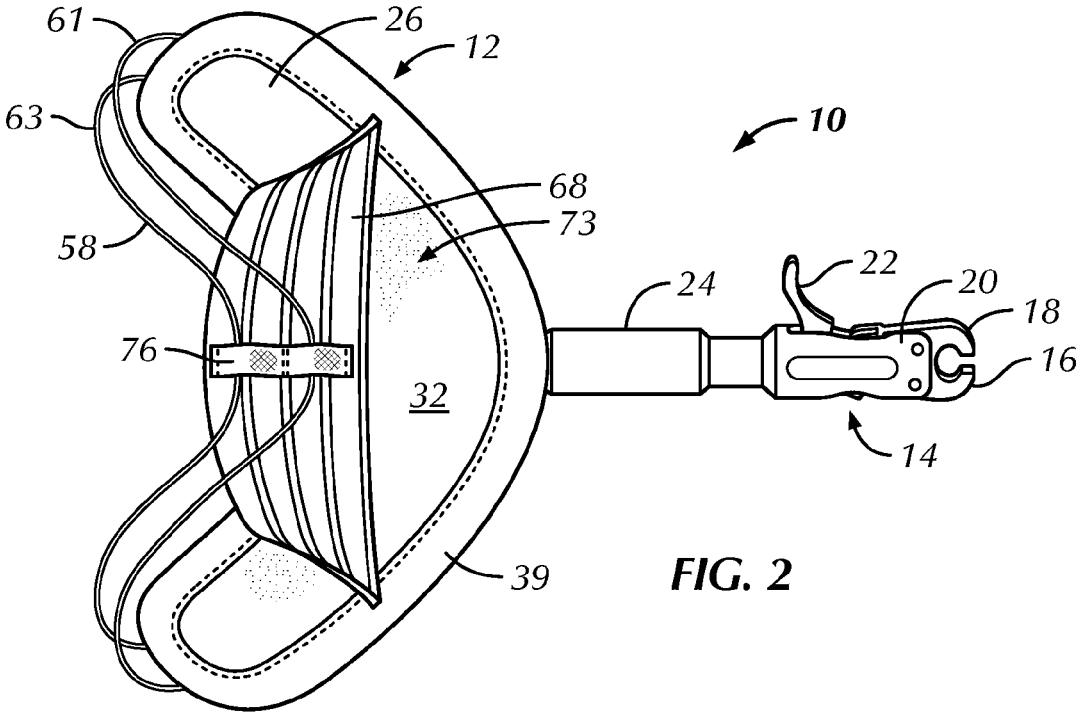
FIG. 2 is a bottom plan view thereof.
Figure 3:
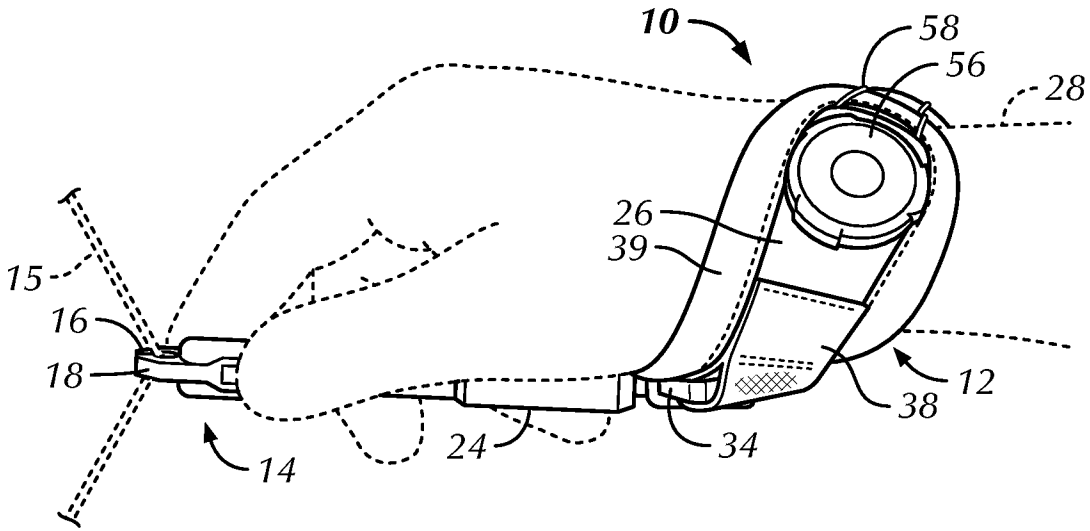
FIG. 3 is a side elevational view thereof mounted on the wrist of a user.

Referring now to the drawings, and to FIGS. 1-3 in particular, a bowstring release assembly 10 in accordance with the present invention is illustrated. The bowstring release assembly 10 preferably includes an adjustable wrist strap 12 and a jaw mechanism 14 that extends from the wrist strap via an extension member 24 for engaging a bowstring 15 (shown in broken line in FIG. 3) and/or a string loop or "D" loop. The present invention is primarily adapted for use with compound bows due to the high pull forces that otherwise may injure the fingers of an archer, but may also be used with recurve bows, reflex bows, longbows, and so on.

The jaw mechanism 14 as shown is of conventional construction and includes a pair of jaws 16, 18 that extend outwardly from a trigger device 20. A trigger 22 forms part of the trigger device and, when pulled, causes movement of one or both jaws toward an open position, as shown in FIGS. 1 and 2, to either release the bowstring or string loop when shooting, or allow entry of the bowstring or string loop into the center of the jaws when getting ready to assume a shooting stance. Likewise, pushing the trigger 22 in the opposite direction causes movement of one or both jaws toward the closed position, as shown in FIG. 3, to encircle the bowstring 15 or string loop. The internal components that permit operation of the jaw mechanism 14 in the above-described manner are well known and therefore will not be further described.

The extension member 24 is connected to the jaw mechanism 14 and the wrist strap 12. The extension member 24 can be adjustable in any well known-manner for accommodating the different hand sizes and preferences of archers so that a proper shooting position can be achieved. It will be understood that other jaw mechanisms and/or trigger devices can be used without departing from the spirit and scope of the invention.

Figure 4:
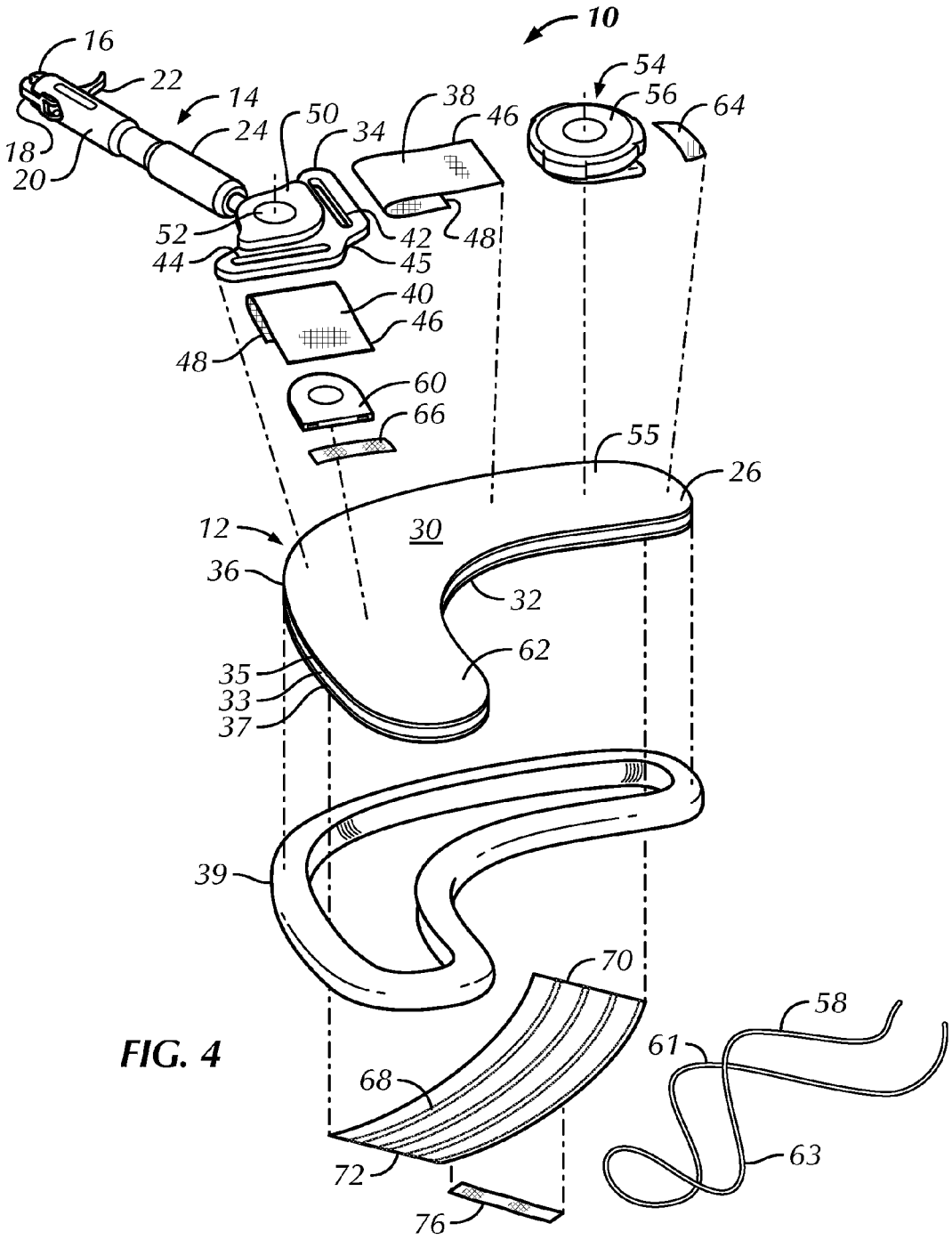
FIG. 4 is an exploded isometric view of the bowstring release assembly with adjustable wrist strap.

With additional reference to FIG. 4, the wrist strap 12 preferably includes a flexible base member 26 that is adapted to at least partially surround the wrist 28 (shown in broken line in FIG. 3) when worn by an archer. The base member 26 is preferably generally V-shaped in construction and has a top surface 30 and bottom surface 32 with an apex portion 36, and a first end portion 55 and a second end portion 62 that diverge from the apex portion 36. It will be understood that the term "end portion" as used herein can include any portion of the flexible base member up to the geometrical center thereof. Preferably, the flexible base member 26 is constructed of a center padding layer 33, an upper lining layer 35, and a lower lining layer 37 that have the same shape as the center layer 33. The center layer, upper layer and lower layer are preferably connected together via a continuous edging 39 that extends around the periphery of the base member and wraps around the edge thereof so that a portion of the edging is positioned on the top surface 30 and bottom surface 32. The edging 39 is preferably connected to the layers by stitching. However, it will be understood that other means for connecting the layers together can be used without departing from the spirit and scope of the invention. The upper and lower layers can be used to add strength to the center layer and can be of any color or pattern, such as various camouflage patterns, to thereby provide both functional and aesthetically pleasing effects. However, it will be understood that the base member 26 can be constructed of a single layer of material or, alternatively, more than three layers of material, without departing from the spirit and scope of the invention.

As best shown in FIGS. 1 and 4, a connecting member 34 is preferably attached to the top surface 30 of the base member 26 at the apex portion 36 thereof via a pair of bands 38 and 40 that extend through slots 42 and 44, respectively, of a bottom wall 45 of the connecting member 34. The bands 38 and 40 are preferably folded over so that the opposite ends 46 and 48 of each band are secured to the base member 26, preferably through stitching, to thereby create loop portions that extend through the slots. However, it will be understood that other means for attaching the connecting member 34 to the base member 26 can be used, including but not limited to, adhesive bonding, clamping, mechanical fastening, and so on. The connecting member 34 preferably includes a top wall 50 and a pivot pin 52 that extends between the top wall 50 and bottom wall 45. The extension member 24 is in turn preferably pivotally connected to the pivot pin to accommodate different hand shapes and sizes, as well as the preferences of individual archers for positioning the trigger device 20 at a desired location with respect to the thumb and/or forefinger of an archer, as shown in FIG. 3.

An adjustment mechanism 54 is connected to the flexible base member 26 for cinching the wrist strap 12 around the wrist 28 (FIG. 3) of a user with virtually infinite adjustment. The adjustment mechanism 54 preferably includes a first anchor member 56 connected to the top surface 30 of the flexible base member 26 at or near the first end portion 55 of the base member, and a second anchor member 60 connected to the top surface 30 at or near the opposite second end portion 62 of the base member 26, and a cable 58 that extends between the first and second anchor members. The first anchor member is preferably in the form of a reel assembly for winding and unwinding the cable 58, as will be described in greater detail below. It will be understood that the position of the first anchor member 56 and second anchor member 60 can be switched without departing from the spirit and scope of the invention.

The cable 58 preferably includes leg segments 61 and 63 that extend from a loop segment. The loop segment preferably extends around the second anchor member 60 while the ends of the leg segments are fixedly connected to the reel assembly (first anchor 56). However, it will be understood that the cable 58 can be fixed directly to the base member 26 and/or to another component of the wrist strap without departing from the spirit and scope of the invention. The cable 58 can be constructed of any suitable material, including but not limited to, metal, plastic, synthetic and/or natural fibers, and so on, in multi-stranded or single-stranded configurations, as long as the cable 58 meets minimal tensile strength requirements reflective of the greatest pull forces of an archery bow, plus an additional safety factor. Accordingly, the term "cable" refers to any elongate, flexible material that meets the tensile strength requirements of a particular archery bow application.

Cable guides 64 and 66 are also preferably connected to the top surface 30 near the end portions 55 and 62, respectively, of the base member 26. The cable guides 64 and 66 are preferably constructed of a flexible material that is resistant to wear and forces that may occur during cinching of the wrist strap 12 and during full draw of the archery bow. When constructed of flexible material, the cable guides 64 and 66 are preferably attached to the base member 26 by stitching. However, it will be understood that other connecting means can be used, such as adhesive bonding, mechanical fastening, clamping, and so on. In addition, it will be understood that the cable guides can alternatively be constructed of a rigid material and attached to the base member 26 in any well-known manner.

As best shown in FIGS. 2 and 4, a band 68 is preferably connected to the bottom surface 32 of the flexible base member 26. The band 68 is preferably constructed of a stretchable material, such as rubber or other elastomers, and includes a first edge 70 that extends transverse to the first end portion 55 of the base member 26 and a second, opposite edge 72 that extends transverse to the second end 62 to thereby form an opening 73. The edges 70, 72 are preferably stitched to the base member 26, although other connecting means can be used, as previously described. The opening 73 is preferably sized to receive the hand of a user so that the wrist strap 12 can be easily installed and held on the wrist even before the wrist strap is cinched. A cable guide 76 is preferably stitched or otherwise attached to the band 68 transverse to the length of the band for receiving the legs 61 and 63 of the cable 58.

The first anchor member 56, embodied as a reel assembly, preferably includes a ratcheting spool such that the cable 58 is wound on the spool when rotated in one direction and is locked against movement in the opposite direction. A suitable reel assembly is disclosed in U.S. Pat. No. 5,934,599 to Hammerslag or U.S. Pat. No. 7,950,112 to Hammerslag et al., the disclosures of which are hereby incorporated by reference.

Figure 5:
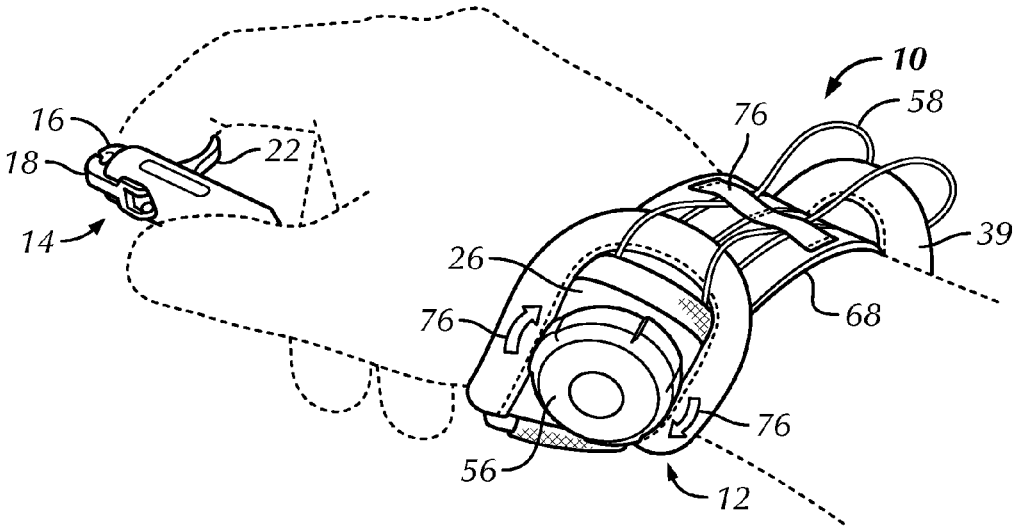
FIG. 5 is a perspective view of the bowstring release assembly with the adjustable wrist strap loosely mounted on the wrist of a user.
Figure 6:
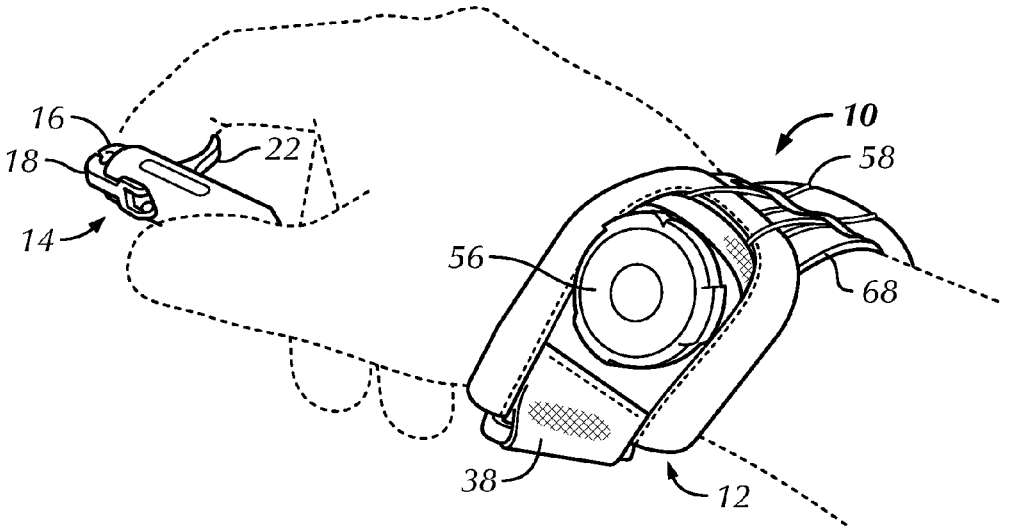
FIG. 6 is a view similar to FIG. 5 with the adjustable wrist strap tightened or cinched around the wrist of a user.

In use, as shown in FIG. 5, the hand of a user is first inserted through the opening 73 until the wrist strap 12 is positioned over the wrist. In this position, the cable 58 will be loose and, depending on the size of the user's wrist, the wrist strap 12 may also be loose. The first anchor member 56 is then rotated in a direction as denoted by arrows 76, to thereby wrap the legs 61, 63 of the cable 58 around the spool until the wrist strap 12 is cinched snugly around the user's wrist, as shown in FIG. 6. In this manner, the wrist strap 12 can be installed and cinched with one hand without the difficulties associated with the prior art as described above.

Figure 7:
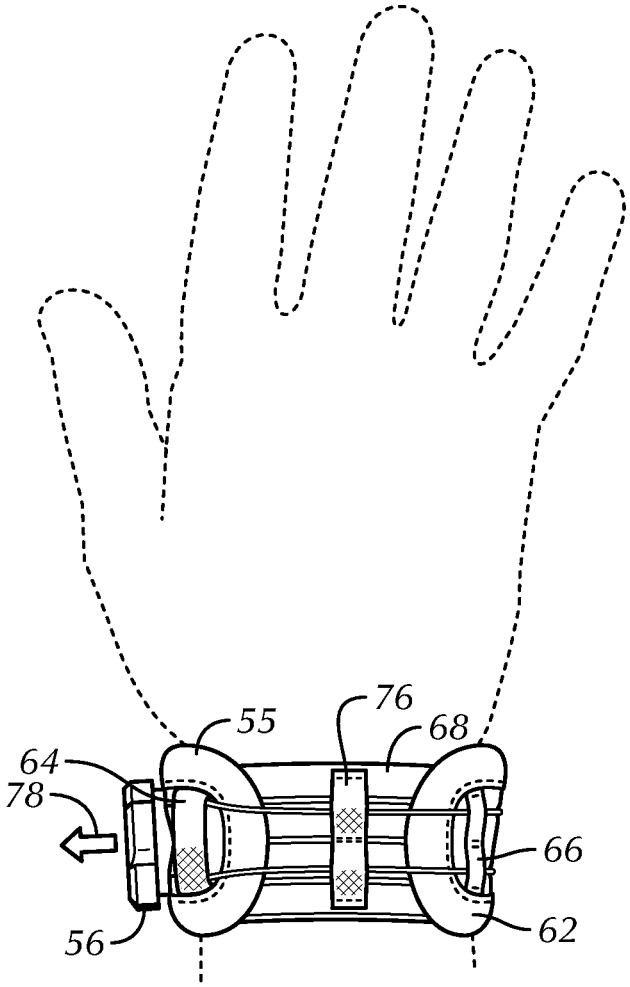
FIG. 7 is a bottom plan view of the adjustable wrist strap mounted on the wrist of an archer and showing how the strap is loosened from the wrist.

In order to release the spool from the locked condition and loosen the cable 58, as shown in FIG. 7, the first anchor member 56 is pulled outwardly, as denoted by arrow 78. In this position, the first anchor member 56 is free to rotate. As the wrist strap 12 is stretched over the hand during removal, the cable 58 will be loosened. The first anchor member 56 can then be pressed in the opposite direction of arrow 78 so that the wrist strap 12 is ready for installation on the hand of a user.

As shown in FIG. 7, the first anchor member 56 is positioned on the left side of the right wrist for easy access by the left hand for installation and removal of the wrist band. However, it will be understood that the first anchor member 56 can be positioned on the right side of the left wrist for left-handed archers so that the right hand has easy access to the reel. In accordance with yet a further embodiment of the invention, the first anchor member 56 can be located at the middle of the wrist to accommodate both left-handed and right-handed archers.

Figure 8:
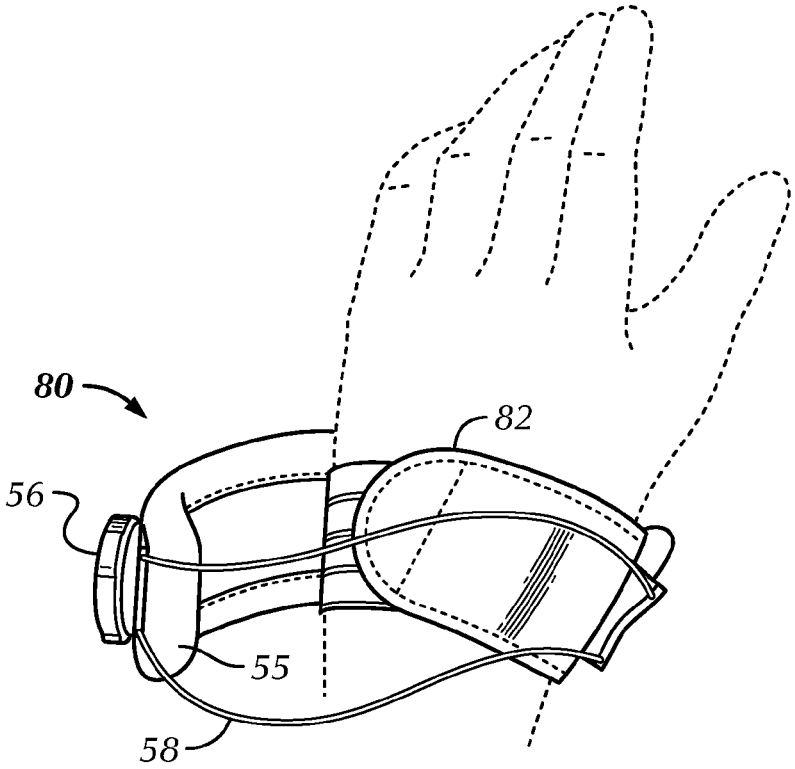
FIG. 8 is a perspective view of a bowstring release assembly with an adjustable wrist strap in accordance with a further embodiment of the invention, loosely mounted on the wrist of a user.
Figure 9:
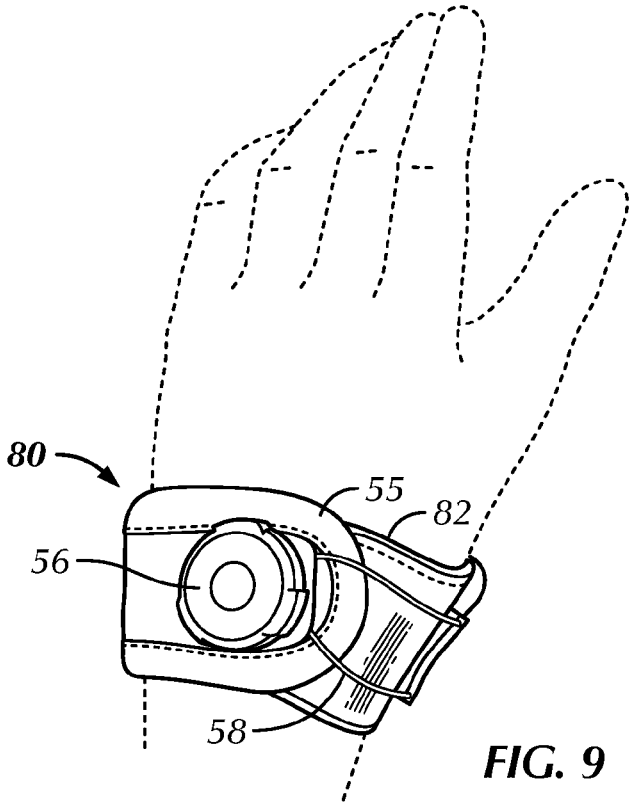
FIG. 9 is a view similar to FIG. 8 with the bowstring release assembly cinched around the wrist of a user.

Referring now to FIGS. 8 and 9, a wrist strap 80 in accordance with a further embodiment of the invention is illustrated. The wrist strap 80 is similar in construction to the wrist strap 12 previously described, with the exception that an end portion 82 of the strap is lengthened so that the end portions of the strap overlap each other when closed.

Figure 10:
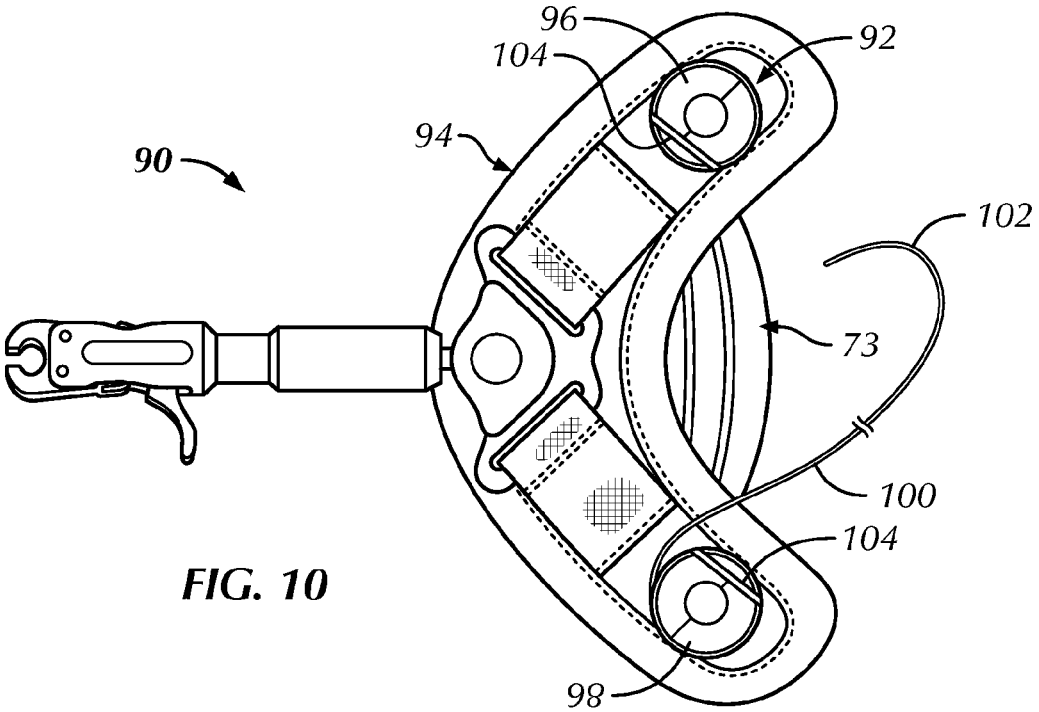
FIG. 10 is a top plan view of a bowstring release assembly with adjustable wrist strap in accordance with yet another embodiment of the invention.
Figure 11:
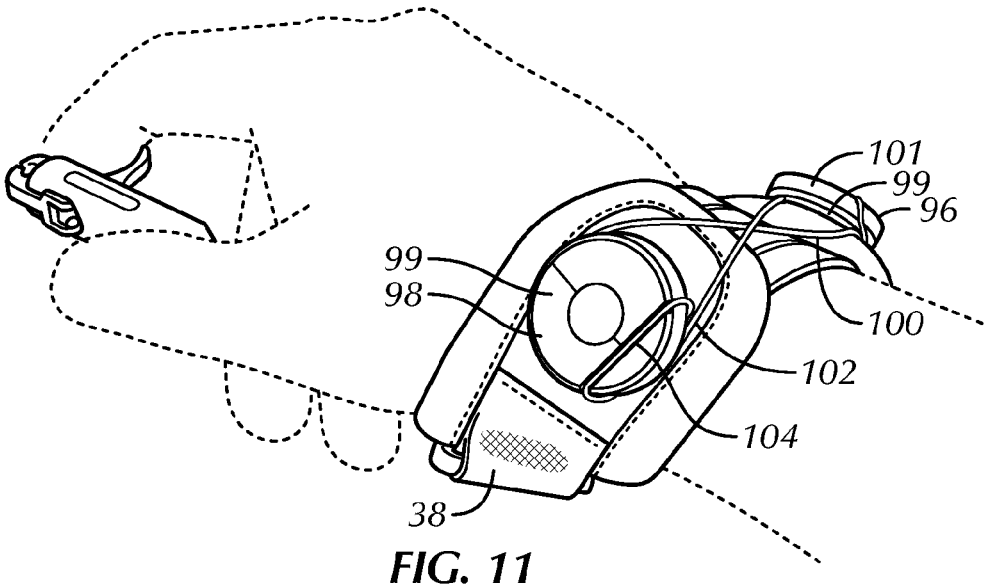
FIG. 11 is a perspective view of the adjustable wrist strap of FIG. 10 cinched around the wrist of a user.

Referring now to FIGS. 10 and 11, a bowstring release assembly 90 in accordance with yet a further embodiment of the invention is illustrated. The bowstring release assembly 90 is somewhat similar to the bowstring release assembly 10 previously described, with the exception that the adjustment mechanism 92 associated with the wrist strap 94 has a first anchor member 96 and a second anchor member 98 that replace the locking reel anchor member 56 and the second anchor member 60 of the previous embodiments. Each anchor member 96, 98 preferably includes a spool portion 99 and a retaining portion 101 located above and extending radially outwardly from the spool portion. A cable 100 is preferably fixedly connected to one of the anchor members and is of sufficient length to be wrapped around both anchor members 96 and 98 when the wrist strap 94 is installed on a user's wrist. The retaining portion 101 ensures that the cable does not come off of the spool portion when wrapped therearound. Although the anchor members 96 and 98 are preferably stationary, they can be constructed to rotate about their central axes without departing from the spirit and scope of the invention.

As shown in FIG. 11, the cable 100 is wrapped around the spool portion 99 of the anchor members 96 and 98, preferably in a figure-eight pattern, for ensuring that the cable 100 will not slip under high tensile loads such as when the archer is in an aiming stance with the archery bow fully drawn. An end 102 of the cable can be inserted into a slot 104 formed in the retaining portion 101 of one or both anchor members to ensure that the loose end does not interfere with or distract from aiming and shooting. Preferably, the slot 104 is sized to frictionally receive and hold the cable 100.

In use, the hand of a user is first inserted through the opening 73 of the wrist strap 94 until the wrist strap is positioned over the wrist. In this position, the cable 100 will be loose or dangling and, depending on the size of the user's wrist, the wrist strap 94 may also be loose. The user then winds the cable 100 around the opposite anchor member and pulls on the cable to cinch the wrist strap 94 comfortably around the user's wrist. The cable 100 is then wound around both anchor members 96 and 98, preferably in a figure-eight pattern, and the end 102 of the cable is inserted into one of the slots 104 on one of the anchor members to thereby secure the cable against slippage. Thus, the bowstring release assembly 90 can be installed and cinched with one hand without the difficulties associated with the prior art as described above. In order to remove the bowstring release assembly 90 from the wrist of a user, the above procedure is reversed.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. A bowstring release assembly adapted for connection to the wrist of a user, the bowstring release assembly comprising:

a jaw mechanism being adapted to receive, retain, and release a bowstring; and an adjustable wrist strap connected to the jaw mechanism, the adjustable wrist strap including:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable connected to one of the anchor members and adapted to engage the other of the anchor members to thereby draw the first and second end portions toward each other and cinch the adjustable wrist strap around the wrist of a user; the cable comprising a loop portion and first and second leg portions extending from the loop portion, with the loop portion extending around the second anchor member and at least one of the first and second leg portions extending around the first anchor member.

2. A bowstring release assembly according to claim 1, and further comprising an extension member located between the jaw mechanism and the adjustable wrist strap.

3. A bowstring release assembly according to claim 2, wherein the base member is generally V-shaped, and further comprising a connecting member located at an apex of the base member, wherein the extension member is pivotally connected to the connecting member.

4. A bowstring release assembly according to claim 1, wherein the first and second leg portions extend around the first anchor member.

5. A bowstring release assembly adapted for connection to the wrist of a user, the bowstring release assembly comprising:

a jaw mechanism being adapted to receive, retain, and release a bowstring; and an adjustable wrist strap connected to the jaw mechanism, the adjustable wrist strap including:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable fixed with respect to one of the anchor members and adapted to engage the other of the anchor members to thereby draw the first and second end portions toward each other and cinch the adjustable wrist strap around the wrist of a user;

wherein the first anchor member comprises a ratcheting spool, with the cable being wound around the spool when the spool is rotated in one direction and is locked against movement in the opposite direction.

6. A bowstring release assembly according to claim 5, wherein the cable comprises a loop portion and first and second leg portions extending from the loop portion, with the loop portion extending around the second anchor member and the first and second leg portions being wound around the ratcheting spool.

7. A bowstring release assembly according to claim 6, wherein the flexible base member comprises an upper surface and a lower surface, with the first and second anchor members being connected to the upper surface.

8. A bowstring release assembly according to claim 6, and further comprising first and second cable guides connected to the first and second end portions, respectively, of the base member, each of the first and second cable guides being adapted to receive the first and second legs of the cable.

9. A bowstring release assembly adapted for connection to the wrist of a user, the bowstring release assembly comprising:

a jaw mechanism being adapted to receive, retain, and release a bowstring; and an adjustable wrist strap connected to the jaw mechanism, the adjustable wrist strap including:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable fixed with respect to one of the anchor members and adapted to engage the other of the anchor members to thereby draw the first and second end portions toward each other and cinch the adjustable wrist strap around the wrist of a user;

wherein the first and second anchor members comprise a spool portion and a retainer portion extending from the spool portion.

10. A bowstring release assembly according to claim 9, wherein the cable is wrapped around the first and second anchor members at least when the adjustable wrist strap is located on the wrist of a user.

11. A bowstring release assembly according to claim 10, wherein the cable is wrapped around the first and second anchor members in a figure-eight pattern.

12. A bowstring release assembly according to claim 10, and further comprising a slot in at least one of the retainer portions, the slot being sized to frictionally receive and hold an end of the cable.

13. An adjustable wrist strap comprising:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable connected to one of the anchor members and adapted to engage the other of the anchor members to thereby draw the first and second end portions toward each other and cinch the adjustable wrist strap around the wrist of a user; the cable comprising a loop portion and first and second leg portions extending from the loop portion, with the loop portion extending around the second anchor member and at least one of the first and second leg portions extending around the first anchor member.

14. An adjustable wrist strap according to claim 13, wherein the first and second leg portions extend around the first anchor member.

15. An adjustable wrist strap comprising:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable fixed with respect to one of the anchor members and adapted to engage the other of the anchor members to thereby draw the first and second end portions toward each other and cinch the adjustable wrist strap around the wrist of a user;

wherein the first anchor member comprises a ratcheting spool, with the cable being wound around the spool when the spool is rotated in one direction and is locked against movement in the opposite direction.

16. An adjustable wrist strap according to claim 15, wherein the cable comprises a loop portion and first and second leg portions extending from the loop portion, with the loop portion extending around the second anchor member and the first and second leg portions being wound around the ratcheting spool.

17. An adjustable wrist strap according to claim 16, wherein the flexible base member comprises an upper surface and a lower surface, with the first and second anchor members being connected to the upper surface.

18. An adjustable wrist strap according to claim 16, and further comprising first and second cable guides connected to the first and second end portions, respectively, of the base member, each of the first and second cable guides being adapted to receive the first and second legs of the cable.

19. An adjustable wrist strap comprising:

a flexible base member adapted to fit around the wrist of a user, the flexible base member having a first end portion, a second end portion, and a middle portion located between the first and second end portions;

a first anchor member connected to the first end portion;

a second anchor member connected to the second end portion; and a cable fixed with respect to one of the anchor members and adapted to engage the other of the anchor members to thereby draw the first and second end portions toward each other and cinch the adjustable wrist strap around the wrist of a user;

wherein the first and second anchor members comprise a spool portion and a retainer portion extending from the spool portion.

20. An adjustable wrist strap according to claim 19, wherein the cable is wrapped around the first and second anchor members at least when the adjustable wrist strap is located on the wrist of a user.

21. An adjustable wrist strap according to claim 20, wherein the cable is wrapped around the first and second anchor members in a figure-eight pattern.

22. An adjustable wrist strap according to claim 20, and further comprising a slot in at least one of the retainer portions, the slot being sized to frictionally receive and hold an end of the cable.

* * * * *